United States Patent [19]

Hannula

[11] 3,955,329

[45] May 11, 1976

[54] HOLLOW STRUCTURE

[76] Inventor: Wayne A. Hannula, 190 Flagg Road, Hubbardston, Mass. 01542

[22] Filed: May 3, 1974

[21] Appl. No.: 466,607

[52] U.S. Cl. ..... 52/81; 52/593

[51] Int. Cl.[2] ..... E04B 1/342; E04C 1/30

[58] Field of Search ..... 52/80, 81, 592, 593

[56] References Cited

UNITED STATES PATENTS

| | | | |
|---|---|---|---|
| 2,336,235 | 12/1943 | Fischer | 52/593 X |
| 2,649,626 | 8/1953 | Hendricksen | 52/593 X |
| 2,682,235 | 6/1954 | Fuller | 52/81 |
| 2,706,838 | 4/1955 | Sears | 52/593 X |
| 2,708,329 | 5/1955 | McKee | 52/593 X |
| 3,062,334 | 11/1962 | Henning | 52/81 |
| 3,085,366 | 4/1963 | Jamison | 52/81 |
| 3,257,930 | 6/1966 | Averna | 52/81 X |
| 3,343,324 | 9/1967 | Gordon | 52/81 X |
| 3,344,565 | 10/1967 | Nye | 52/81 |
| 3,359,694 | 12/1967 | Hein | 52/81 |
| 3,530,620 | 9/1970 | Heieren | 52/81 |
| 3,817,011 | 6/1974 | Weed | 52/593 X |
| 3,820,292 | 6/1974 | Fitz | 52/81 |

FOREIGN PATENTS OR APPLICATIONS

| | | | |
|---|---|---|---|
| 1,180,304 | 6/1959 | France | 52/592 |
| 1,282,156 | 12/1961 | France | 52/80 |
| 582,430 | 11/1946 | United Kingdom | 52/593 |
| 717,697 | 9/1965 | Canada | 52/81 |
| 60,419 | 12/1942 | Denmark | 52/80 |
| 429,803 | 6/1935 | United Kingdom | 52/592 |
| 200,583 | 1/1939 | Switzerland | 52/592 |
| 273,537 | 7/1927 | United Kingdom | 52/593 |

*Primary Examiner*—Ernest R. Purser
*Assistant Examiner*—Leslie A. Braun
*Attorney, Agent, or Firm*—Thompson, Birch, Gauthier & Samuels

[57] ABSTRACT

A hollow structure, such as a small shelter or a large auditorium constructed wholly of novel structural cells which are assembled without the need of nails, bolts, screws, or glue. The structure has a generally spherical or frusto-spherical shape formed by a plurality of circular horizontal rows of interlocked cells, the size and shape of cells in vertically adjacent rows bearing a certain mathematical relationship to one another.

10 Claims, 16 Drawing Figures

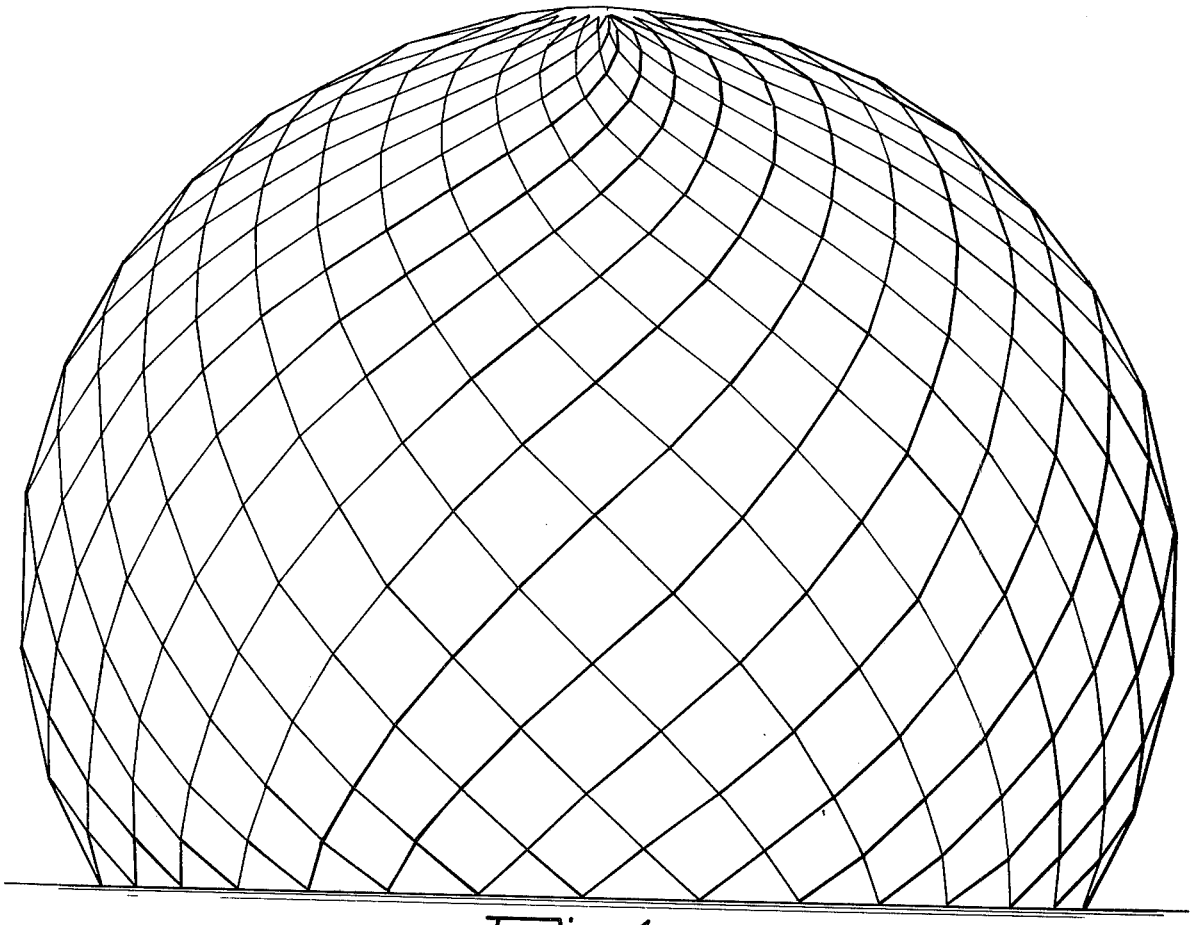
Fig. 1.
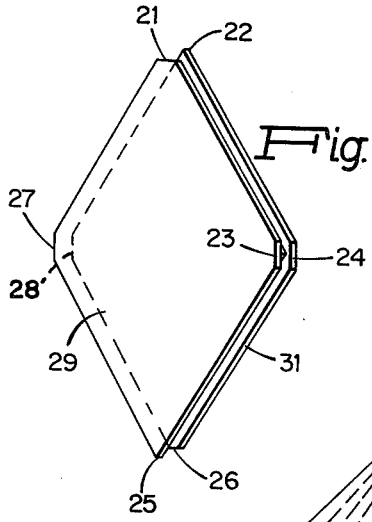
Fig. 3.
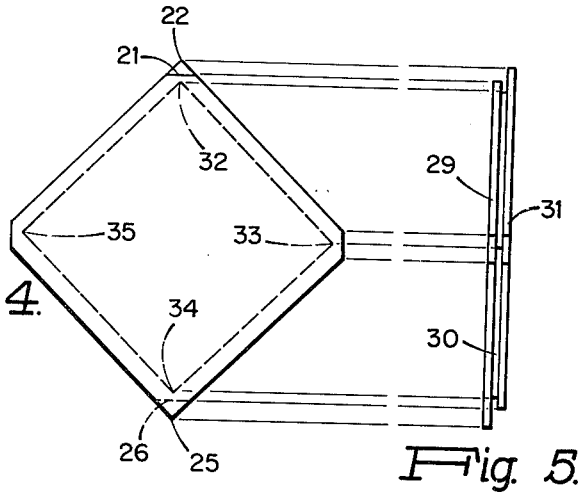
Fig. 4.
Fig. 5.
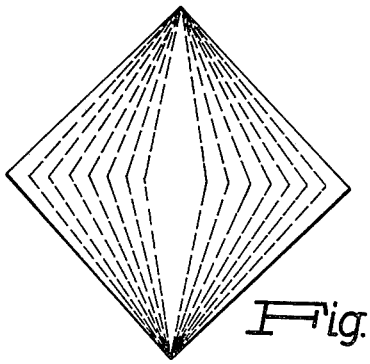
Fig. 6.

HOLLOW STRUCTURE

BACKGROUND OF THE INVENTION

It has long been desired to be able to erect self-supporting, hollow structures without the need of conventional types of fasteners. Such structures would be useful as homes, shops, greenhouses, barns, silos, and general storage units. Such structures have particular utility where not only is ease of construction important, but ease of disassembly for portability is also important. In such applications as auditoriums, sports arenas, theatres and airplane hangars, the advantages of a self-supporting unobstructed structure are particularly evident. Previous attempts at building these structures have required special building components, special equipment, considerable manpower for assembly or, in some cases, special types of mechanical fasteners.

FIELD OF THE INVENTION

This invention is particularly directed to a novel type of interlocking structural element and the novel self-supporting structures formed by assembling such structural elements without employing fasteners.

DESCRIPTION OF THE PRIOR ART

In early U.S. Pat. No. 604,277, a knockdown house is described. The structure is of generally hemispherical shape consisting of grooved vertical ribs and overlapping plates held together by bars or bands at the base and apex which provide the support for the structural elements. U.S. Pat. No. 791,149 describes a cylindrical self-supporting structure consisting of specially formed building blocks with grooves and flanges. It is evident that it is the massive compression strength of each of the cement blocks which supports the weight of the structure. R. Buckminster Fuller appears to have been one of the first to recognize and apply the principle of geometric structural interdependence as described in U.S. Pat. No. 2,682,235 for the construction of geodesic domes. Fuller found that he could reduce the weight of conventional wall and roof designs from approximately 50 lbs. per square foot to as low as 0.78 lbs. per square foot by employing a generally spherical frame consisting of structural elements interconnected in a geodesic pattern of great circle arcs to form a three-way grid and thereby uniformly distribute stressing in the structural members. Other variations of the Fuller spherical dome idea are illustrated by U.S. Pat. Nos. 3,359,694 and 3,485,000.

SUMMARY OF THE INVENTION

The present invention is directed to a novel type of generally spherical or frusto-spherical structure which may be readily assembled employing a plurality of novel light-weight structural cells by a single individual without special equipment or fasteners. Because of the special shape of the cells and the manner in which they are assembled, the result is a self-supporting structure of variable size and shape, which is essentially weatherproof, and which may also be easily dismantled and transported to a different location.

Accordingly, it is an object of this invention to provide a structure which can be assembled without nails, bolts, screws, latches, rods, magnets or glue.

It is also an object of this invention to provide a self-supporting structure.

Another object of this invention is to provide a structure which can be readily assembled or dismantled by a single individual without special equipment or tools.

Yet another object of this invention is to provide a structure which is sealed against heat, wind, rain, snow or other elements.

Still another object of this invention is to provide a structure which does not require an additional bulky layer of insulation.

Further objects and advantages of this invention will become apparent as the description proceeds.

BRIEF DESCRIPTION OF THE DRAWINGS

FIG. 1 is an elevation of a frusto-spherical dome constructed according to the present invention.

FIG. 3 is a perspective view of a structural cell according to the present invention.

FIGS. 4 and 5 are front and side elevations of the structural cell shown in FIG. 3.

FIG. 6 illustrates the variations in size and shape which structural cells would have in vertically adjacent horizontal rows.

DESCRIPTION OF THE PREFERRED EMBODIMENT

Referring now more particularly to the drawings, FIG. 1 illustrates an essentially three-quarter frusto-spherical dome. There is no criticality either in the diameter of the dome or in what proportion of the overall sphere is used, which is to say that the dome may be started at any convenient latitude or diameter to suit particular needs or tastes. In general, it is believed that a substantially hemispherical form would be most desirable in that it maximizes floor space. It will be appreciated that the ultimate size of the dome will vary according to both the size of the individual structural cells and the number used in each horizontal row. By manipulating these two variables, almost any size dome can be constructed.

Figure 2:
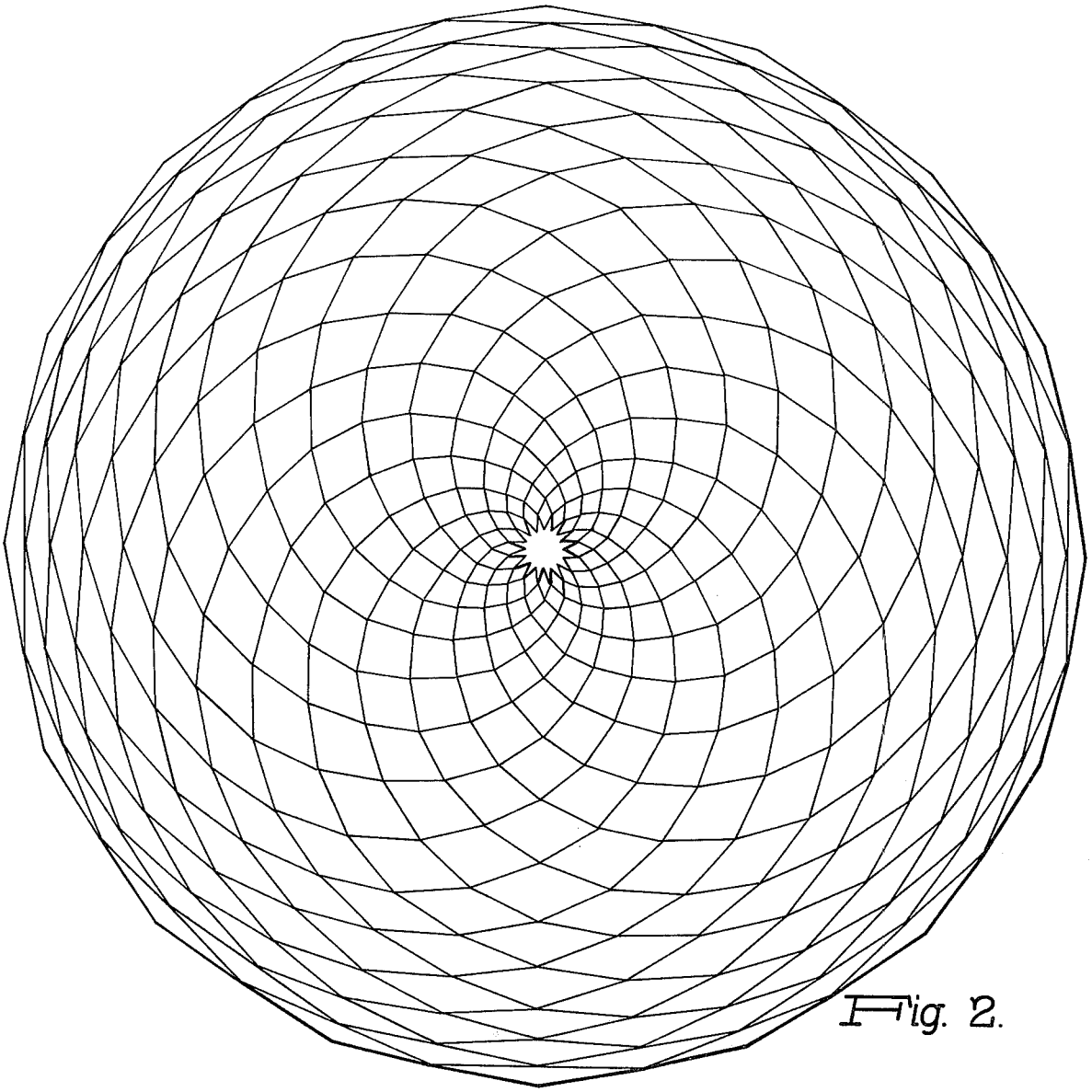
FIG. 2 is a top view of the dome shown in FIG. 1 with the capping piece omitted.
Figure 15:
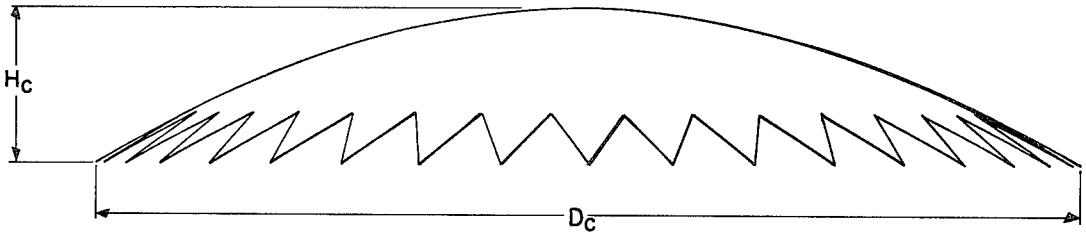
FIG. 15 is an elevation of a capping piece for the dome according to the present invention.

FIG. 2 illustrates the sunburst-like opening which is left at the top of a constructed dome. Theoretically, of course, one could continue to add rows of structural cells according to the mathematical formula until the opening was reduced to any desired size; however, the increasingly narrow cells which would be necessary for this purpose would be difficult to fashion and too fragile to be worked into place. Therefore, in practice, when the necessary width of the cells becomes quite small, for example less than 2 inches, a capping piece is fashioned to fit over the remaining opening. This piece can be designed as a jagged circular piece with grooved edges to interlock with the last row of cells as shown in FIG. 15. Such a piece can be difficult to work into place unless the fabrication material is particularly flexible. Of course, the capping piece can also be fastened or adhered to the last row of cells. An easier method which provides somewhat less additional structural support, but is effective as a closure, is simply an inverted saucer-shaped element somewhat larger than the opening which may be fastened or glued in place over the opening for easy removal at a later time. A third possibility is to use half cells for the last row, similar to those used for the base or foundation cells. The shape of the opening would then be a multi-sided polygon approaching a circle and a round rubber capping piece somewhat like a large bathtub stopper could be wedged in to provide a leak-tight closure.

FIG. 3 is a perspective view of a structural cell which illustrates how the grooved edges of the plate form eight plate corners 21–28, the last corner 28 not being visible in this drawing. Six of the eight plate corners, 21, 23, 24, 26, 27 and 28, are cut off, but bottom corner 25 on exterior plate 29 and top corner 22 on interior plate 31 are left intact as overlapping seals at the juncture points, as explained subsequently.

FIG. 4 is a front view of a structural cell shown together with a FIG. 5 side view projection which illustrates the edge grooves and cut off corners. All four plate corners along the horizontal diagonal are cut off, whereas only two of the four plate corners along the vertical diagonal are cut off. As the projected side view illustrates, the lower corner on the exterior face of the plate and the upper corner on the interior face are left intact. As shown in the projected side view, the grooves are centered midway between the opposite faces of the cell and are one-third the thickness of the cell thickness thus creating a sandwich-like structure of three equally thick plates, exterior plate 29, center plate 30, and interior plate 31, the center plate 30 being of identical shape as plates 29 and 31, but of smaller surface area. Instead of starting with a single plate and putting grooves along the edges by conventional means, it is often advantageous to form the grooved cells from three plates of appropriate size and shape fastened together by such means as screws, bolts or adhesive. The depth of the grooves is not critical but is, conveniently, about two-thirds the thickness of the structural cell. Thus, for example, if a cell is three-eighths of an inch thick, it would have grooves one-eighth of an inch thick and one-quarter of an inch deep.

The corners are cut off along a line which runs midway between the plate corners and the adjacent groove corners 32, 33, 34 and 35.

Figure 12:
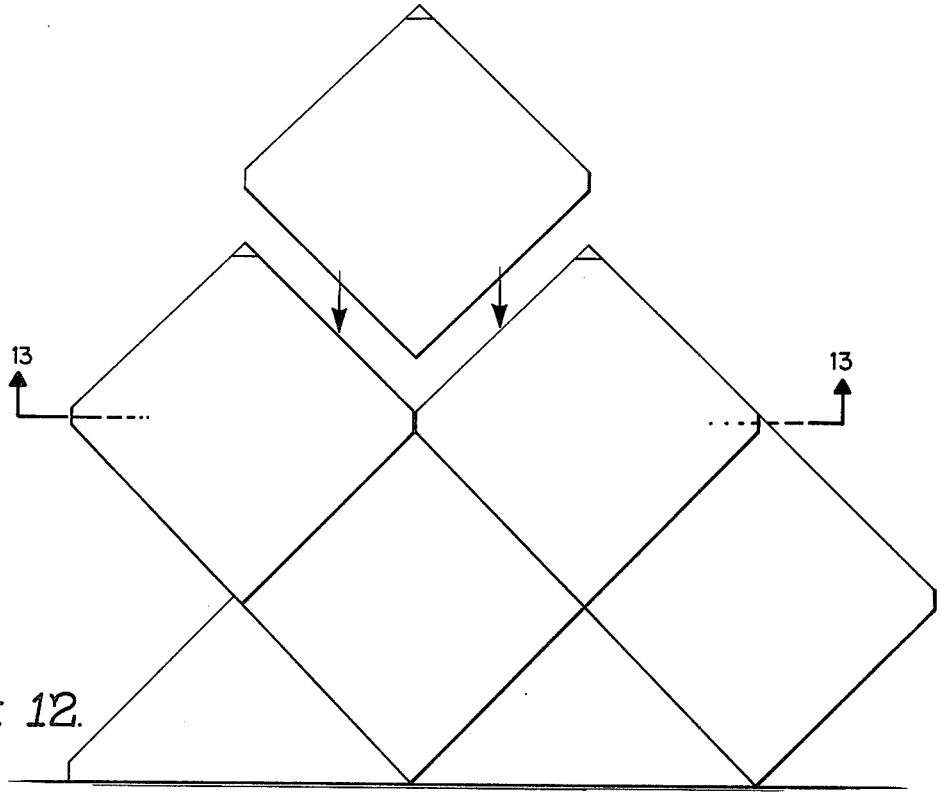
FIG. 12 is an elevation showing the interlocking of a structural cell with other structural and foundation cells.

FIG. 6 illustrates the variations in the shape of the cells in accordance with the present invention. The outer solid line represents a square cell. Square cells, or halves of square cells, are used along the equatorial line of the dome. If the dome is, for example, a three-quarter sphere as shown by FIG. 1, complete square cells are used and their horizontal diagonals run along the equatorial line. When an essentially hemispherical structure is desired, halves of square cells cut along a diagonal become the base or foundation cells with the diagonal forming the baseline as shown in FIG. 12.

It is evident that, moving up and down from the equatorial line of the spherical dome, the size and shape of the cells must change to accommodate the same number of cells along a smaller circumference. This can be accomplished in many ways if both the length and width of the cells are considered variable. However, to do so would require intricate calculations for each new row of cells. Thus, in the preferred embodiment of this invention, the length of the vertical diagonal of the cells is constant; and thus the relationship between the size and shape of cells in successive vertically adjacent horizontal rows reduces to a simple, easily computed mathematical formula. FIG. 6 illustrates by dotted outline how the width or horizontal diagonal of the cells becomes progressively smaller in accordance with the mathematical formula while the length or vertical diagonal remains unchanged.

FIGS. 7–10 illustrate four modified embodiments whereby the grooved cells can be made according to the present invention.

Figure 7:
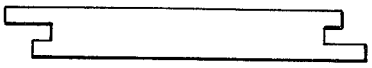
FIGS. 7–10 are sections of modified structural cells fabricated by alternative methods.

FIG. 7 shows a single plate of material such as wood, plastic or light-weight metal, which has been grooved by conventional means.

Figure 8:
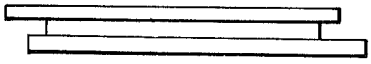

FIG. 8 shows a layered composite structure wherein three plates of suitable material are cut to the proper size and assembled sandwich-style using bolts, screws, rivets, adhesives or other conventional fasteners. The three plates need not be fashioned from the same material; and, in a preferred embodiment, the center plate is cut from a sheet of insulating material.

Figure 9:
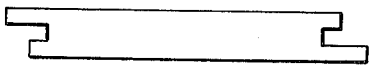

FIG. 9 shows a cell which has been molded in a single piece by employing a thermo-formable fabrication material.

Figure 10:
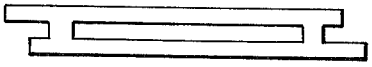

FIG. 10 illustrates a preferred variation of the one-piece molded cell described above wherein a pocket of air is encapsulated within each cell both to reduce material costs and to serve as insulation.

Figure 11:
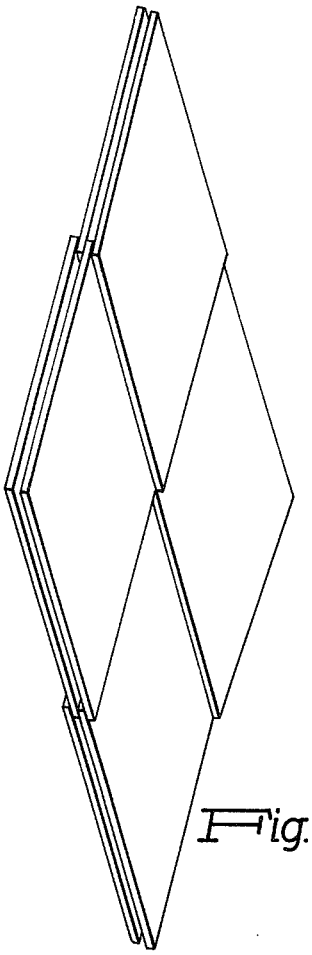
FIG. 11 is a perspective view of four interlocked structural cells.

FIG. 11 is a perspective illustration of the interlocking edges of four cells according to the present invention.

Figure 13:
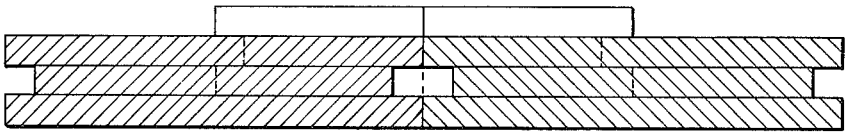
FIG. 13 is a section taken along line 13—13 on FIG. 12.

FIG. 12 illustrates the start of a dome built according to the present invention. The base or foundation cells are simply full cells cut in half along the horizontal diagonal. Although FIG. 12 shows halves of square cells used for a generally hemispherical dome, as noted earlier, the dome can be started at any desired point in the same fashion. FIG. 13 clarifies the overlapping relationship of adjoining cells.

Figure 14:
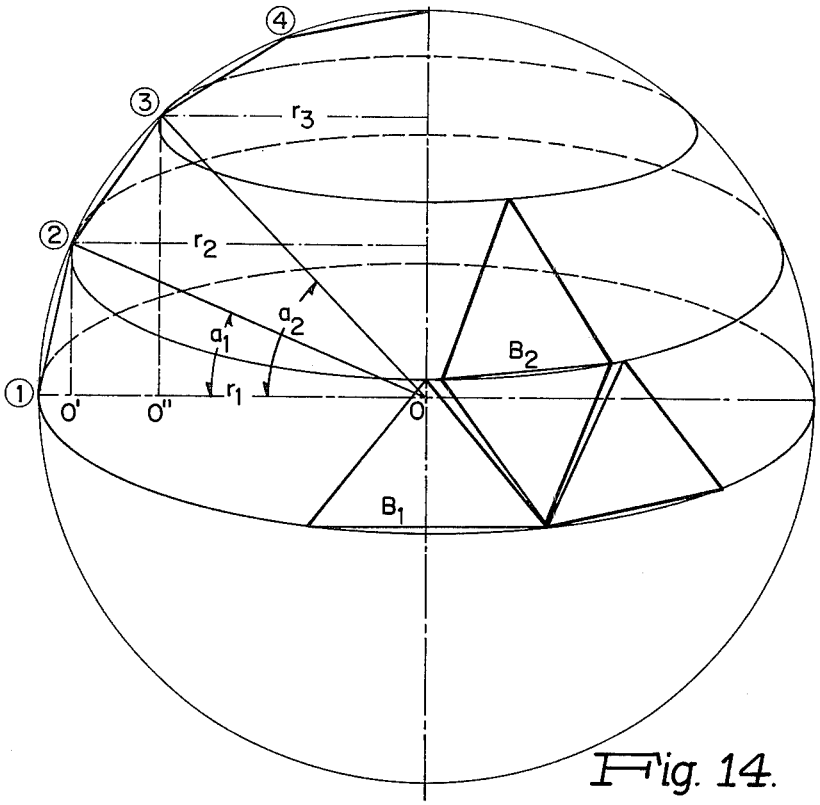
FIG. 14 is a geographical spherical model of the present invention.

FIG. 14 is a geographic representation of a sphere to illustrate how the mathematical relationship between cells in vertically adjacent rows is derived. For this purpose, the following definitions are adopted:

N — number of cells in every horizontal circular row.

$n$ — number of a specific row counting up or down from the equator with row 1 being the row whose horizontal diagonal lies in the equatorial plane.

$B_n$ — length of baseline (horizontal diagonal) of each cell in row $n$.

$C_n$ — circumference of circle described by a horizontal plane passing through the sphere with each baseline $B_n$ of each cell in row $n$ lying in the plane.

$r_n$ — radius of circle of circumference $C_n$.

$a_{(n-1)}$ — acute angle formed by the intersection of two lines lying in a vertical plane, both running from the center of the sphere, one to a point on the baseline of row $n$, and the other to a point on the baseline of row 1.

Starting with a half square cell as the base or foundation cell for a hemispherical dome, the baseline $B_1$ can easily be measured. The baseline $B_2$ of each cell in row 2 is calculated according to conventional geometry as follows (the explanation of the calculation is set forth after the calculation):

Calculation of $B_2$

1. $C_1 = N(B_1)$

2. $r_1 = \frac{C_1}{2\pi} = \frac{N(B_1)}{2\pi}$ 3. length of 90° arc $= \frac{C_1}{4} = \frac{N(B_1)}{4}$ 4. $\frac{a_1}{90°} = \frac{\frac{B_1}{2}}{\frac{N(B_1)}{4}} = \frac{2}{N}$ $a_1 = \left(\frac{180}{N}\right)^{\circ}$ 5. $\cos a_1 = \frac{r_2}{r_1} = \frac{r_2}{\frac{N(B_1)}{2\pi}} = \frac{2\pi}{N(B_1)} r_2$ therefore $r_2 = \frac{N(B_1)}{2\pi} \cos a_1$ $= \frac{N(B_1)}{2\pi} \cos \left(\frac{180}{N}\right)^{\circ}$ 6. $C_2 = 2\pi r_2 = \left[2\pi \frac{N(B_1)}{2\pi} \cos \left(\frac{180}{N}\right)^{\circ}\right]$ $= N(B_1) \cos\left(\frac{180}{N}\right)^{\circ}$ 7. $B_2 = \frac{C_2}{N} = \boxed{(B_1) \cos \left(\frac{180}{N}\right)^{\circ}}$

EXPLANATION OF CALCULATION STEPS

Step 1: The equatorial circumference $C_1$ is made up of N cells each having baseline $B_1$.

Step 2: The radius of the equatorial circle is equal to the circumference divided by twice pi (the mathematical constant equal to approximately 3.1416, to four decimal places).

Step 3: Any two planes which pass through the center of a sphere describe circles of the same size. Thus, the circle described by the vertical plane (the face of FIG. 14) is the same size as that described by the imaginary horizontal plane (shown as solid and dotted lines), and has the same circumference $C_1$. A complete circle describes an arc of 360°; therefore, an arc of 90° intercepts one-quarter of the circumference.

Step 4: The ratio of the length of the arc intercepted by each cell in row 1 along the face of the sphere to the length of the arc intercepted by a 90° angle equals the ratio between angle $a_1$ and 90°. It is at this point that an important approximation is made. The actual length of the arc between points 1 and 2 on the face of the sphere is unknown. However, the length of the chord between points 1 and 2 is a good approximation of that length. The length of the chord, of course, is just half the vertical diagonal, which for a square is half the horizontal diagonal, i.e. $B_1/2$.

Step 5: In the right-angle triangle 0-2-0', the hypotenuse 0-2 is merely the radius of the sphere $r_1$. The long side 0-0' is seen to be equal to radius $r_2$, the radius of the circle described by passing a horizontal plane through the sphere at a point which intersects the tops of the cells in row 1. By trigonometry, the cosine of angle $a_1$ equals the length of side 0-0' divided by the length of side 0-2, or $r_2/r_1$ Step 6: Knowing $r_2$, the circumference of the circle $C_2$ is computed by the reverse of step 2.

Step 7: Knowing $C_2$ and given the fact that the number of cells in each horizontal row remains constant, the length of the baseline of the cells in row 2, $B_2$, is easily computed.

Calculation of $B_3$

Condensing the number of steps, $B_3$ would be calculated as follows:

1. length of 90° arc $= \frac{N(B_1)}{4}$

2. $\frac{a_2}{90°} = \frac{2(B_1/2)}{\frac{N(B_1)}{4}} = \frac{4}{N}$

3. $\cos a_2 = \frac{r_3}{r_1} = \frac{2\pi r_3}{N(B_1)}$ therefore $r_3 = \frac{N(B_1)}{2\pi} \cos a_2$ $= \frac{N(B_1)}{2\pi} \cos \left(\frac{360}{N}\right)^{\circ}$ 4. $C_3 = 2\pi r_3 = N(B_1) \cos \left(\frac{360}{N}\right)^{\circ}$ 5. $B_3 = \frac{C_3}{N} = \boxed{(B_1) \cos \left(\frac{360}{N}\right)^{\circ}}$ Calculation of General Formula By following the same steps outlined above, a general formula is derived for calculating the size of the cells in any row of a dome built according to the present invention as follows:

1. $\frac{a_{(n-1)}}{90°} = \frac{(n-1)(B_1/2)}{\frac{N(B_1)}{4}} = \frac{2(n-1)}{N}$ $a_{(n-1)} = \left(\frac{(n-1)\,180}{N}\right)^{\circ}$ 2. $\cos a_{(n-1)} = \frac{r_n}{r_1} = \frac{2\pi}{n(B_1)} r_n$ therefore $r_n = \frac{N(B_1)}{2\pi} \cos \left(\frac{(n-1)\,180}{N}\right)^{\circ}$ 3. $C_n = 2\pi r_n = N(B_1) \cos \left(\frac{(n-1)\,180}{N}\right)^{\circ}$ 4. $B_n = C_n/N = \boxed{(B_1) \cos \left[\frac{(n-1)\,180}{N}\right]^{\circ}}$ Thus the general formula is:

$$B_n = (B_1) \cos \left[\frac{(n-1)\,180}{N}\right]^{\circ}$$

All that needs to be selected is the approximate desired size of the spherical dome and the size of the base or foundation cells to be able to calculate the number and size of all the cells necessary for construction by a simple trial and error process.

EXAMPLE

To build a hemispherical dome approximately 12 feet in height (i.e. radius), starting with square units having a 10 inch diagonal or baseline (i.e., about 7 inches along each side):

A. Calculation of Cells/Row

Approximate desired radius $= r_a = 12'$
$= 144''$

Approximate circumference $= C_a = 2\pi\,(144'')$
$= 904''$

Approximate number of cells/row $= N_a = C_a/B_1$
$= \frac{904''}{10''}$
$= 90.4$ Because only whole cells can be used, this approximate figure is rounded off to 90 cells/row. Proceeding backwards, the actual size of the dome can now be calculated:

Actual circumference $= C_1 = (N)\ (B_1)$
$= (90)\,(10'')$
$= 900''$

Actual radius $= r_1 = \frac{C_1}{2\pi}\left(\frac{1'}{12''}\right)$ $= 11.95'$ b. Calculation of Cell Size Row 1: $B_n = (B_1)\cos\left(\frac{(n-1)\,180}{N}\right)^\circ$ $B_1 = (B_1)\cos\left(\frac{(1-1)\,180}{90}\right)^\circ$ $= (10'')\cos 0^\circ$ $= 10''$ (which, as it should be, is the size selected for the base cells)

Row 2: $B_2 = (10'')\cos\left(\frac{(2-1)\,180}{90}\right)^\circ$ $= (10'')\cos 2^\circ = 9.99''$ Row 3: $B_3 = (10'')\cos\left(\frac{(3-1)\,180}{90}\right)^\circ$ $= 10''\cos 4^\circ = 9.98''$ Row 4: $B_4 = 10''\cos 6^\circ = 9.95''$
Row n: $B_n = 10''\cos(n-1)\,(2)^\circ$
Row 45: $B_{45} = 10''\cos(44)\,(2)^\circ$
$= 10''\cos 88^\circ = 0.348''$
Row 46: $B_{46} = 10''\cos(45)\,(2)^\circ$
$= 10''\cos 90^\circ$
$= 0$ This last calculation is performed merely as a check on the formula and shows that there can be no more than N/2 rows since that equals one half of the circumference $C_1$. Practically, however, it would not be feasible to have a $B_n$ less than about 2 inches because it is necessary to accommodate the edge grooves. To calculate the last possible row, work backwards as follows:

Row 45: $B_{45} = 10''\,(\cos 88^\circ)$
$= 10''\,(.0348)$
$= .348''$
Row 44: $B_{44} = 10''\,(\cos 86^\circ)$
$= 10''(.0698)$
$= .698''$
Row 43: $B_{43} = 10''\,(\cos 84^\circ)$
$= 10''\,(.105)$
$= 1.05''$
Row 42: $B_{42} = 10''\,(\cos 82^\circ)$
$= 10''\,(.139)$
$= 1.39''$
Row 41: $B_{41} = 10''\,(\cos 80^\circ)$
$= 10''\,(.174)$
$= 1.74''$
Row 40: $B_{40} = 10''\,(\cos 78^\circ)$
$= 10''(.208)$ -continued $= 2.08''$ Thus you would have 40 rows of units closed by a capping piece.

C. Calculation of Capping Piece

FIG. 15 illustrates the fitted capping piece which is defined in terms of its height, $H_c$, and its diameter, $D_c$. $D_c$ is easily calculated since it equals the diameter of a circle whose circumference, $C_{40}$, is the product of the number of cells in each row and the length of the baseline in the last row.

$C_{40} = (N)\,(B_{40})$ $D_c = \frac{C_{40}}{\pi} = \frac{(90)\,(2.08'')}{\pi}$ $= 59.6''$ The height, $H_c$, is equal to the difference between half the diameter of the sphere, $r_1 = 11.95'$, and the vertical distance from the center of the sphere to the horizontal plane passing through the baseline of the last row of cells, $H_{40}$. The latter figure may be calculated by trigonometry as follows:

$\sin a_{(n-1)} = \frac{H_n}{r_1}$ $\sin a_{39} = \frac{H_{40}}{11.95'}$ $H_{40} = 11.95 \sin a_{39}$ The angle, $a_{39}$, is computed by dividing 90° by the total number of rows of cells to obtain the number of degrees per row of cells, then multiplying by the appropriate number of rows:

$a_{39} = 39\left(\frac{90^\circ}{N}\right) = 39\left(\frac{90^\circ}{45}\right)$ $= 78^\circ$ therefore Therefore $H_{40} = (11.95)\,(\sin 78^\circ)$
$= 11.70'$
$H_c = 11.95 - 11.70$
$= 0.25'$ Thus it is seen that the capping piece is an almost flat, essentially circular plate which could be fashioned from a flat sheet of any reasonably flexible material such as wood, plastic or hard rubber, and bent into shape. The size of the piece is under five feet and could be put into place by a single individual without special tools or equipment.

Figure 16:
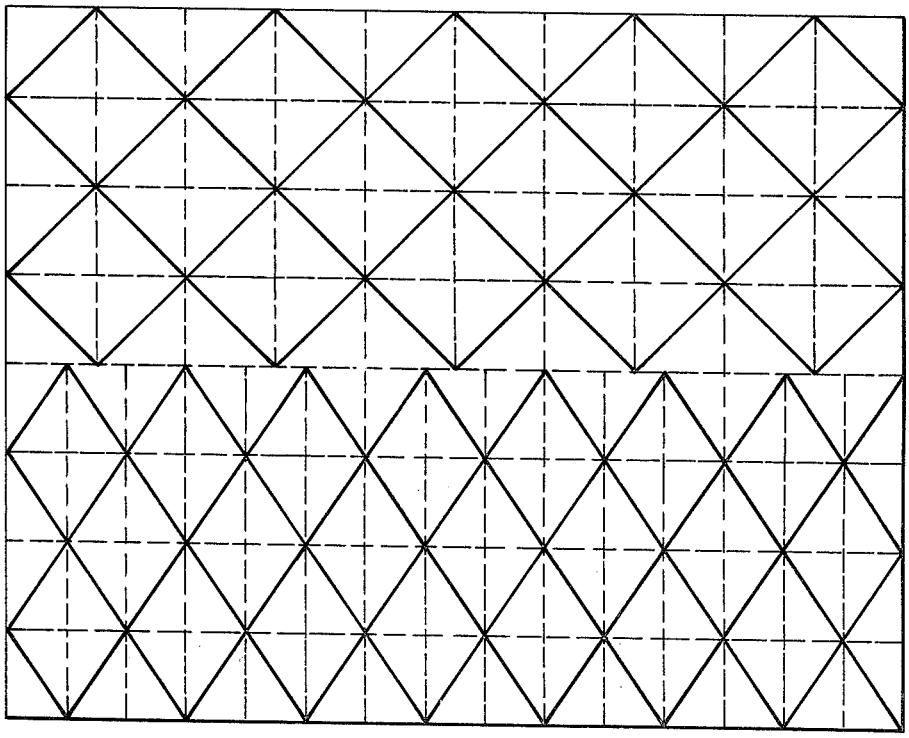
FIG. 16 illustrates the cutting of a sheet of fabrication material to make structural cells according to the present invention.

FIG. 16 illustrates a particularly economical way of manufacturing the structural cells of the present invention. For any given structure, as earlier explained, the vertical diagonal of each of the cells remains constant and only the width or horizontal diagonal varies from row to row. Thus, a single sheet of fabrication material would be scored width-wise at equal intervals which were one-half the length of the vertical diagonal shown in the drawing as dotted lines. Next, the sheet would be scored length-wise at equal intervals which were one-half the length of the horizontal diagonal for the particular row of cells being manufactured to form a two-dimensional rectangular grid also shown as dotted lines. The same sheet could be scored for two or more different-sized cells, as shown in FIG. 16, by stopping the first length-wise scores after two, four, six or any even number of width-wise scores, and changing the interval between the length-wise scores. After scoring, the individual cells are cut from the sheet by sawing along every other diagonal (shown as solid lines in the drawing) as defined by the grid intersections. Such a procedure is relatively easy, maximizes the number of cells produced from any given sheet of fabrication material, and is readily adopted to the sandwich-like construction of cells which was previously explained.

My invention is not limited to the preferred embodiment as described above and other modes of practising the invention are contemplated herein. Although the invention has been described in terms of dome-like structures, it will be evident to those skilled in the art that the novel interlocking and self-sealing structural cells which I have described have applications in structures of all shapes. For example, a rectangular structure with flat walls could be constructed using cells of a single size. Also, although the invention has been described in terms of rhombus-shaped cells, it will be appreciated that triangular and hexagonal cells have the same properties of fitting together with one another. By mixing cells of different types of shapes in a single structure the principles of my invention could be applied to all shapes known to man. In all cases the cells have the same advantages of simplicity of assembly and great strength as a unit compared with the individual strength of each cell alone.

Having described my invention what I claim is:

1. A hollow structure having a generally spherical or frusto-spherical shape comprising:

a. a plurality of superposed circular horizontal rows of interlocked cells, all of said cells in any given horizontal row being identical in size and shape, and being different in size and shape from all of said cells in any given vertically adjacent row according to a specific mathematical formula;

b. each of said cells having a rhombus shape and substantially flat major interior and exterior plate surfaces and having a continuous groove of substantially uniform width and depth running along all four cell edges to form eight plate corners and four groove corners on each said cell;

c. said grooved cell edges of any given cell being lockably inserted into the corresponding grooved cell edges of all given adjacent cells to interlock all of said cells into a unitary structure in such a fashion that said major surfaces of any two horizontally adjacent cells lie in substantially the same plane and said major surfaces of any two vertically adjacent cells lie in different planes, the exterior plate surface of the upper of said two vertically adjacent cells overlapping the exterior plate surface of the lower of said cells;

d. each said cell having six of said eight plate corners cut off, excluding the lower exterior corner and the upper interior corner, said cut-offs being substantially perpendicular to their respective rhombus diagonals, said interlocked cells forming a double overlapping seal at each four-cell juncture.

2. The structure of claim 1, wherein said continuous groove in each said cell runs along the centerline of said cell edges and has a width equal to one-third of the width of said cell edges.

3. The structure of claim 1, wherein said six cut-off corners are each cut off along a line running midway between said plate corner and said groove corner associated with said plate corner.

4. The structure of claim 1, wherein the cells along the equator of the generally spherical structure are squares with one horizontal diagonal baseline lying along the equator, and wherein the cells in vertically adjacent rows above and below the equatorial line have vertical diagonals equal in length to those of the equatorial cells but whose horizontal diagonal baselines progressively decrease in size according to the formula:

$$B_n = (B_1) \cos \left[\frac{(n-1)}{N} \; 180^\circ\right]$$

wherein:

N = the number of cells in every horizontal circular row.

$n$ = the number of a specific row counting up or down from the equator, the equatorial cells being in row number 1.

$B_n$ = the length of the horizontal diagonal baseline of each cell in row $n$.

5. The structure of claim 4 wherein the cells are made of wood and are assembled by fastening two cell faces to the opposite sides of an identically-shaped element of smaller surface area to form a three-layered composite cell with uniformly grooved edges.

6. The structure of claim 5 wherein the identically-shaped element of smaller surface area is made from a sheet of insulating material.

7. The structure of claim 4 wherein the cells are made of plastic which has been molded to have uniformly grooved edges.

8. The structure of claim 7 wherein each molded cell contains an enclosed insulating air pocket.

9. The structure of claim 1, wherein the uppermost portion of the hollow structure is a capping piece which overlaps the uppermost row of interlocked cells and completes the structure.

10. The structure of claim 1, wherein said structure is assembled from a package comprising a plurality of sets of structural cells, each set comprising a plurality of cells of the same size, all of said sets containing the same number of cells, each of said cells in said package being rhombus-shaped with the vertical diagonal being of the same length and the horizontal diagonal varying in length from set to set according to a specific mathematical formula.

* * * * *